US012668858B2

(12) United States Patent
Inoue

(10) Patent No.: US 12,668,858 B2
(45) **Date of Patent: *Jun. 30, 2026**

(54) TITANIUM POROUS BODY, AND METHOD FOR PRODUCING TITANIUM POROUS BODY

(71) Applicant: Toho Titanium Co., Ltd., Kanagawa (JP)

(72) Inventor: Yosuke Inoue, Kanagawa (JP)

(73) Assignee: Toho Titanium Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/730,825

(22) PCT Filed: Dec. 27, 2022

(86) PCT No.: PCT/JP2022/048428

§ 371 (c)(1),
(2) Date: Jul. 22, 2024

(87) PCT Pub. No.: WO2023/145375

PCT Pub. Date: Aug. 3, 2023

(65) Prior Publication Data

US 2025/0101545 A1 Mar. 27, 2025

(30) Foreign Application Priority Data

Jan. 31, 2022 (JP) ..... 2022-012824

(51) Int. Cl.

| | |
|---|---|
| ***C22C 1/08*** | (2006.01) |
| ***B22F 1/05*** | (2022.01) |
| ***B22F 1/10*** | (2022.01) |
| ***B22F 3/11*** | (2006.01) |
| ***B22F 5/00*** | (2006.01) |
| ***C22C 14/00*** | (2006.01) |

(52) U.S. Cl.

CPC ..... *C22C 1/08* (2013.01); *B22F 1/05* (2022.01); *B22F 1/10* (2022.01); *B22F 3/11* (2013.01); *B22F 5/006* (2013.01); *C22C 14/00* (2013.01)

(58) Field of Classification Search

None

See application file for complete search history.

(56) References Cited

U.S. PATENT DOCUMENTS

| | | | | |
|---|---|---|---|---|
| 11,370,025 | B2 * | 6/2022 | Gallagher | B22F 5/10 |
| 2008/0147177 | A1 * | 6/2008 | Scheuermann | A61L 27/30 623/1.42 |
| 2013/0156945 | A1 * | 6/2013 | Saukaitis | B01D 69/12 427/201 |
| 2016/0015483 | A1 * | 1/2016 | Kumar | C04B 41/4582 606/301 |
| 2023/0084462 | A1 | 3/2023 | Inoue et al. | |

FOREIGN PATENT DOCUMENTS

| | | | |
|---|---|---|---|
| JP | 2011-099146 | A | 5/2011 |
| JP | 2014-065968 | A | 4/2014 |
| JP | 2014-084505 | A | 5/2014 |
| JP | 2014-239023 | A | 12/2014 |
| WO | WO-2007/138806 | A1 | 12/2007 |
| WO | WO-2021-171747 | A1 | 9/2021 |

OTHER PUBLICATIONS

Hackemueller et al., "Manufacturing of Large-Scale Titanium-Based Porous Transport Layers for Polymer Electrolyte Membrane Electrolysis by Tape Casting", Advanced Engineering Materials, vol. 21, 2019, 10 pages.

Extended European Search Report in EP Application No. 22924222.7 dated May 26, 2025, 9 pages.

International Preliminary Report on Patentability in International Application No. PCT/JP2022/048428 dated Aug. 6, 2024, 6 pages.

Search Report in International Application No. PCT/JP2022/048428 filed Mar. 14, 2023, 4 pages.

* cited by examiner

*Primary Examiner* — Seth Dumbris

(74) *Attorney, Agent, or Firm* — Marshall, Gerstein & Borun LLP

(57) ABSTRACT

The titanium porous body according to the present invention is in a form of a sheet, and has a thickness of 0.3 mm or less, and a bending strain at break of 0.005 or more, wherein, for a three-dimensional surface texture of at least one surface of the titanium porous body, an arithmetic mean height Sa is 2.5 μm or less, a maximum height Sz is 30 μm or less, an aspect ratio Str of the surface texture is 0.93 or more, and an arithmetic mean curvature Spc of a peak is 4.8 (1/μm) or less.

20 Claims, No Drawings

TITANIUM POROUS BODY, AND METHOD FOR PRODUCING TITANIUM POROUS BODY

TECHNICAL FIELD

The present invention relates to a titanium porous body in a form of a sheet, and a method for producing the titanium porous body.

BACKGROUND ART

Conventional titanium porous bodies and methods for producing them are disclosed, for example, in Patent Literatures 1 and 2.

Patent Literature 1 discloses:

"A sintered metal sheet material for electrochemical members, the sintered metal sheet material comprising a metal sintered body obtained by sintering metal powder, the sintered metal sheet material having a plurality of pores dispersed therein, the porosity being 10% by volume or more and 50% by volume or less, the average pore size of the pores being 1 μm or more and 30 μm or less, and the plurality of pores being disposed so that some of the pores are open to the surface", wherein "the metal sintered body is made of Ti with a C content of 0.5% by mass or less and an O content of 1% by mass or less". Patent Literature 1 describes a production method for the "sintered metal sheet material for electrochemical members" that includes a "slurry preparation step", a "molding step", a "drying step", a "degreasing step" and a "sintering step". In the "slurry preparation step", it discloses:

"a slurry is prepared by mixing titanium raw material powder with an organic binder, water, and optionally a plasticizer". Also, for the "drying step", it discloses:

"the temperature inside the drying tank 25 is adjusted to, for example, 40 to 90° C., and a slurry S formed into a thin plate passes through the drying tank 25 for, for example, 10 to 30 minutes".

Patent Literature 2 discloses:

"A method for producing a titanium powder sintered body, comprising the steps of: producing secondary titanium particles in which primary titanium particles are spherically aggregated; mixing the secondary titanium particles with a binder to form a slurry; processing the slurry into a plate-shaped body; drying the plate-shaped body; heating the dried molded body to remove the binder in the molded body; and sintering the molded body obtained by removing the binder". For the "slurry", Patent Literature 2 discloses:

"the produced titanium spherical secondary particles are mixed with a solvent and a solvent soluble binder or the like to form a slurry"; and "the types of the solvent are not particularly important, and a commonly used solvent may be used in a general mixing ratio, and a wide variety of solvents, such as water, various alcohols, and various ketones, can be used, for example". Patent Document 2 also discloses:

"the prepared sintering raw material titanium powder was kneaded with 10% by weight of a water-soluble acrylic binder (AP-2 from YUKEN INDUSTRY CO., LTD.), 3.5% by weight of a plasticizer (VL-A Test 1 from YUKEN INDUSTRY CO., LTD.), and water to form a slurry".

CITATION LIST

Patent Literature

[PTL 1]
Japanese Patent Application Publication No. 2011-99146 A
[PTL 2]
WO 2007/138806 A1

SUMMARY OF INVENTION

Technical Problem

By the way, a titanium porous body has air and liquid permeability due to its numerous pores, and electrical conductivity, as well as high corrosion resistance due to formation of a passive film on its surface. Therefore, the use of the titanium porous body as a PTL (Porous Transport Layer) in an environment where corrosion may occur in a PEM water electrolytic device is under consideration.

Such an application may require a titanium porous body that is in a thin sheet form and is difficult to be damaged during handling, such as during transportation or attachment to the device, from the viewpoint of miniaturization of the device and ease of handling.

In the PEM water electrolysis device and the like as described above, the titanium porous body may be disposed in close contact with other members such as electrode layer. In this case, it is desirable that at least one surface of the titanium porous body is smooth in order to improve the adhesion between the titanium porous body and other members.

Patent Literatures 1 and 2 do not pay any attention to smoothing the surface of the titanium porous body. Also, it has been newly found that when water is added to the "slurry" as in the production methods described in Patent Literatures 1 and 2, the smoothness of the surface of the titanium porous body finally obtained is impaired.

An object of the present invention is to provide a titanium porous body in a form of a relatively thin sheet, which is difficult to be broken during handling and has one smooth surface, and to provide a method for producing a titanium porous body.

Solution to Problem

As a result of intensive studies, the present inventors have found that adjustment of the compositions of the titanium powder and the paste as well as the drying temperature of the paste can provide a titanium porous body that is difficult to be broken during handling, even in the form of a relatively thin sheet, at least one surface of which has a required smoothness. Specifically, using a pulverized titanium powder having a hydrogen content of 0.1% by mass or less, a paste that is free of water or a foaming agent is dried on a substrate at a temperature of 100° C. or more and 130° C. or less. This results in a molded body. Subsequently, the organic substances in the molded body are volatilized, and the titanium powder is sintered. In this way, the titanium porous body as described above is obtained.

The titanium porous body according to the present invention is in a form of a sheet, and has a thickness of 0.3 mm or less, and a bending strain at break of 0.005 or more, wherein, for a three-dimensional surface texture of at least one surface of the titanium porous body, an arithmetic mean height Sa is 2.5 μm or less, a maximum height Sz is 30 μm or less, an aspect ratio Str of the surface texture is 0.93 or more, and an arithmetic mean curvature Spc of a peak is 4.8 (1/μm) or less.

The titanium porous body as described above preferably has a porosity of 30% or more and 50% or less.

The titanium porous body may have a titanium content of 97% by mass or more.

The titanium porous body as described above may have a carbon content of 0.01% by mass or more and 0.06% by mass or less.

The method for producing a titanium porous body according to the present invention is a method for producing a titanium porous body in a form of a sheet, the method comprising: a drying step of drying a paste applied onto a substrate by heating the paste on the substrate at a temperature of 100° C. or more and 130° C. or less to obtain a molded body in a form of a sheet, the paste containing titanium powder, an organic binder, and an organic solvent, the titanium powder being a pulverized powder having a hydrogen content of 0.1% by mass or less, the paste being free of water or a foaming agent; a preheating step of heating the molded body to volatilize organic substances in the molded body; and a sintering step of heating the molded body after the preheating step to sinter the titanium powder in the molded body.

In the production method as described above, it is preferable that the preheating step is carried out after the molded body obtained in the drying step is separated from the substrate.

In the above production method, it is preferable that the titanium powder in the paste used in the drying step has a 10% particle size D10 of 5 μm or more and 15 μm or less, and a 90% particle size D90 of 15 μm or more and 25 μm or less.

In the drying step, it is preferable to use, as the paste, a paste having a ratio (Ms/Mb) of a mass Ms of the organic solvent to a mass Mb of the organic binder of 2.0 or more and 9.0 or less.

The titanium powder is preferably a hydride-dehydride titanium powder.

The ratio (Ms/Mb) of the mass Ms of the organic solvent to the mass Mb of the organic binder in the paste is preferably 2.5 or more and 6.0 or less.

In the preheating step, the molded body is preferably heated in an air atmosphere at a temperature of 300° C. or more and less than 450° C. for a period of time of 3 hours or more and 12 hours or less.

In the sintering step, the molded body is preferably heated at a temperature of 700° C. or more and 850° C. or less for a period of time of 1 hour or more and 4 hours or less.

Advantageous Effects of Invention

The titanium porous body according to the present invention is in a form of a relatively thin sheet and is difficult to be broken during handling, at least one surface of which is smooth. The method for producing a titanium porous body according to the present invention is suitable for producing such a titanium porous body.

DESCRIPTION OF EMBODIMENTS

Embodiments of the present invention will be described in detail below.

The titanium porous body according to an embodiment of the present invention is in a form of a sheet and has a thickness of 0.3 mm or less, and a bending strain at break of 0.005 or more, at least one surface of which has a predetermined three-dimensional surface texture (surface roughness). The predetermined three-dimensional surface texture is such that an arithmetic mean height Sa is 2.5 μm or less, a maximum height Sz is 30 μm or less, an aspect ratio Str of the surface texture is 0.93 or more, and an arithmetic mean curvature Spc of a peak is 4.8 (1/μm) or less. The titanium porous body is difficult to be broken during handling due to its large bending strain at break, and the above surface can be said to have the required smoothness needed for a predetermined application.

The method for producing a titanium porous body includes a drying step of drying a paste containing titanium powder, an organic binder and an organic solvent by heating the paste on a substrate at a temperature of 100° C. or more and 130° C. or less to obtain a molded body in a form of a sheet; a preheating step of heating the molded body to volatilize organic substances in the molded body; and a sintering step of heating the preheated molded body to sinter the titanium powder in the molded body. The method may further include a paste preparation step of preparing the above paste and a paste application step of applying the paste onto a substrate before the drying step.

In the above production method, it is important that the paste contains pulverized titanium powder having a hydrogen content of 0.1% by mass or less, but does not contain water or a foaming agent, and that the paste is heated at a temperature of 100° C. or more and 130° C. or less in the drying step.

If titanium powder having a relatively high hydrogen content is used, hydrogen is released by heating during sintering, causing contraction and reducing the smoothness of the surface of the titanium porous body. Also, the use of pulverized titanium powder increases the bending strain at break of the titanium porous body. If the paste contains water in addition to the organic solvent, the difference in drying behavior between the organic solvent and water causes the mixed state of the titanium powder and the organic binder in the paste to become disturbed, resulting in the formation of pinholes on the surface of the titanium porous body. Examples of the difference in drying behavior include the organic solvent being volatilized and removed before water during drying, and the difference in affinity between the organic solvent and water for the titanium powder and organic binder. Further, if the paste contains a foaming agent, large voids are locally formed in the titanium porous body due to the foaming agent, so that the smoothness of the surface is decreased and it is easily cracked during handling.

If the drying temperature is too high, the organic solvent in the paste tends to boil, causing roughness on the surface of the titanium porous body. On the other hand, if the drying temperature is too low, drying takes a long time, during which the liquid in the paste becomes sparse and the mixed state of the titanium powder and organic binder is disturbed, so that pinholes are formed and so on, thereby deteriorating the smoothness of the surface of the titanium porous body.

The production method according to this embodiment suppress the occurrence of the problems described above, so that it is possible to produce a good titanium porous body.

(Composition)

The titanium porous body is made of titanium. If it is made of titanium, a titanium porous body having high electrical conductivity can be obtained with a certain relative density. The titanium content of the titanium porous body is 97% by mass or more, preferably 98% by mass or more. A higher titanium content is preferred, and the titanium content may be 99.8% by mass or less, or 99% by mass or less or less.

The titanium porous body may contain Fe as an impurity, with an Fe content of 0.25% by mass or less, for example. The titanium porous body may also contain Ni, Cr, Al, Cu, Zn, and Sn as unavoidable impurities resulting from the production process, for example. It is suitable that the content of each of Ni, Cr, Al, Cu, Zn, and Sn is less than 0.10% by mass, and the total content thereof is preferably less than 0.30% by mass.

When the titanium porous body according to this embodiment is produced using a paste containing titanium powder as described below, carbon in the organic substances contained in the paste may remain, resulting in a relatively high carbon content. Specifically, the carbon content of the titanium porous body may be 0.01% by mass or more and 0.06% by mass or less, and typically 0.01% by mass or more and 0.04% by mass or less. The carbon content can be measured by a combustion infrared absorption method.

The titanium porous body may have a purity corresponding to pure titanium types 1-4 in JIS H 4600 (2012), typically type 1 or 2, except for the oxygen content and the nitrogen content.

(Thickness)

The titanium porous body in the form of the sheet has a thickness of 0.3 mm or less, preferably 0.02 mm or more and 0.3 mm or less, more preferably 0.02 mm or more and 0.2 mm or less. Depending on the application, such a lower thickness may be required. It should be noted that the term "form of a sheet" for the titanium porous body means a plate shape or a foil shape having a smaller thickness with respect to planar view dimensions, and there is no particular limitation on the shape in the planar view.

The thickness is measured at five points in total: four at the periphery and one at the center of the titanium porous body, using a digital thickness gage having a flat measuring element of 10 mm in diameter and a measurement accuracy of 0.001 to 0.01 mm, such as Mitutoyo's digital thickness gage (Model No. 547-321), for example. An average of these measurements is used as an average value. If the titanium porous body in the form of the sheet is rectangular in the planar view, the above four points of the periphery should be the four points of the four corners.

(Porosity)

The porosity of the titanium porous body is preferably 30% or more and 50% or less, more preferably 35% or more and 50% or less. The porosity in such a range can suppress breakage during handling while ensuring the required air permeability or liquid permeability depending on the application. If the porosity is 30% or more, a good air or liquid permeability is obtained. On the other hand, if the porosity is 50% or less, cracks will be difficult to occur during handling.

A porosity ε of the titanium porous body is calculated using a volume calculated from the width, length and thickness of the titanium porous body and an apparent density ρ' calculated from the mass, and a true density ρ (4.51 g/cm$^3$) of the titanium that makes up the titanium porous body, according to the equation: $\varepsilon=(1-\rho'/\rho)\times 100$.

When the titanium porous body is produced using titanium powder as described below, the skeleton of the three-dimensional network structure that defines the voids of the titanium porous body tends to be sponge titanium-shaped. The skeleton of the sponge titanium-shaped three-dimensional network structure is similar to the shape of the sponge titanium produced by the Kroll process. On the other hand, when titanium fibers are used, the skeleton of the three-dimensional network structure that defines the voids of the titanium porous body is often in a nonwoven shape. Further, in the method of using a paste containing titanium powder and organic binder, etc., drying the paste and then sintering the titanium powder, if the paste contains a foaming agent, the titanium porous body thus produced is susceptible to the formation of voids even within the skeleton due to the effect of the foaming agent.

(Bending Strain at Break)

The bending strain at break of the titanium porous body is 0.005 or more. As will be described later in the Examples section, the titanium porous body may not be broken in a test for the bending strain at break. Such a titanium porous body can be difficult to be broken and can have excellent handling properties. Therefore, there is no particular upper limit for the bending strain at break. However, there may be a preferred upper limit for the bending strain at break in view of the intended use, etc.

The bending strain at break of the titanium porous body is measured by a three-point bending test. The specimen has dimensions: a length of 60 mm, a width of 15 mm, a distance between supports of 22.5 mm, a diameter of 5 mm of each of an indenter and the support, and a test rate of 2 mm/min. Other conditions are in accordance with JIS K 7171 (How to determine bending properties of plastics). the bending strain & is calculated by the equation: $\varepsilon_f=6\ sh/L^2$ in which s is deflection (mm), h is a thickness of the specimen (mm), and L is a distance between supports (mm). The bending strain at break is the bending strain when the specimen is broken. The measuring device that can be used is, for example, Techno Graph TG-1KN from Minebea.

(Three-Dimensional Surface Texture)

The surface roughness on at least one surface of the titanium porous body has an arithmetic mean height Sa of 2.5 μm or less. The arithmetic mean height Sa means an average value of absolute values of the heights from the average plane of the surface. If the arithmetic mean roughness Sa is 2.5 μm or less, the smoothness of the surface is ensured. As a result, it will be difficult to damage adjacent members disposed adjacent to the titanium porous body in a PEM water electrolysis device or the like. From this viewpoint, the arithmetic mean height Sa of at least one surface of the titanium porous body is preferably 2.0 μm or less. The arithmetic mean height Sa of at least one surface of the titanium porous body may be, for example, 1.0 μm or more and 2.5 μm or less, or may be, for example, 1.0 μm or more and 2.0 μm or less.

The surface roughness on at least one surface of the titanium porous body has a maximum height Sz of 30 μm or less. The maximum height Sz means a distance from the highest point to the lowest point on the surface. The maximum height Sz of 30 μm or less ensures the smoothness of the surface, so that it is difficult to damage adjacent members. The maximum height Sz of at least one surface of the titanium porous body is preferably 25 μm or less. The maximum height Sz of at least one surface of the titanium porous body may be, for example, 18 μm or more and 30 μm or less, or may be, for example, 18 μm or more and 25 μm or less.

The surface texture of the surface roughness on at least one surface of the titanium porous body has an aspect ratio Str of 0.93 or more. The aspect ratio Str of the surface texture represents isotropy and anisotropy on a horizontal plane (a plane parallel to the surface). The aspect ratio Str of the surface texture is a value of 0 to 1, and a value close to 0 means that there is anisotropy such as streaks, while a value close to 1 means that there is isotropy without depending on directions. If the aspect ratio Str of the surface texture is 0.93 or more, there is isotropy, and the diffusion of the fluid can be made more uniform. Also, because of the high isotropy, it is difficult to damage adjacent members of the titanium porous body. The aspect ratio Str of the surface texture is preferably 0.95 or more. The aspect ratio Str of the surface texture of at least one surface of the titanium porous body may be 0.99 or less. The aspect ratio Str of the surface texture of at least one surface may be, for example, 0.93 or more and 0.99 or less, and may be, for example, 0.95 or more and 0.99 or less.

An arithmetic mean curvature Spc of the peak of the surface roughness on at least one surface of the titanium porous body is 4.8 (1/μm) or less. The arithmetic mean curvature Spc of the peak means an average curvature (average sharpness) of the tip of the peak. When the arithmetic mean curvature Spc of the peak is 4.8 (1/μm) or less, the tip of the peak is gentle and is difficult to damage adjacent members. The arithmetic mean curvature Spc of the peak of at least one surface of the titanium porous body is preferably 4.0 (1/μm) or less, more preferably 3.6 (1/μm) or less. The arithmetic mean curvature Spc of the peak of at least one surface of the titanium porous body may be, for example, 2.0 (1/μm) or more and 4.8 (1/μm) or less, or, for example, 2.0 (1/μm) or more and 4.0 (1/μm) or less, or, for example, 2.0 (1/μm) or more and 3.6 (1/μm) or less.

To measure the arithmetic mean height Sa, the maximum height Sz, the aspect ratio Str of the surface texture and the arithmetic mean curvature Spc of the peak as described above, a laser microscope is used, specifically, a 3D laser scanning confocal microscope VK-X1000/1050 manufactured by KEYENCE CORPORATION can be used. In the surface shape measurement mode, an area having a length of 500 μm and a width of 750 μm is measured at magnifications of 50 times. This is measured at five points per a sample, and an average value of the measurements at the five points for Sa, Sz, Str, and Spc should satisfy the above predetermined numerical criteria. That is, in the titanium porous body according to this embodiment, for at least one surface, the average value of the arithmetic mean heights Sa at five points is 2.5 μm or less, the average value of the maximum heights Sz at five points is 30 μm or less, the average value of the aspect ratios Str of the surface textures at five points is 0.93 or more, and the average value of the arithmetic mean curvatures Spc of the peaks at five points is 4.8 (1/μm) or less. When using VK-X1000/1050, the Sa, Sz, Str, and Spc are parameters that are calculated as standard without any special setting changes, so their detailed calculation formulae will be omitted, but the Sa represents the average absolute value of the height from the average surface of the surface, and the Sz represents the distance from the highest point to the lowest point of the surface, which are standardized by ISO 25178. The Str represents the aspect ratio of the surface texture, and is calculated as a ratio ($r_{min}/r_{max}$) of the shortest distance $r_{min}$ to the longest distance $r_{max}$ in the lateral direction at which the autocorrelation value decays to 0.2. The Spc represents the average sharpness of the tip of the peak, and the curvature of the peak is calculated for peaks that are higher than 5% of the maximum amplitude of the contour curved surface, and an arithmetic mean value thereof is determined to be Spc.

When the titanium porous body having at least one surface with the three-dimensional surface texture as described above is used in, for example, a PEM water electrolysis device, it is expected to have excellent adhesion to adjacent members such as an electrolyte membrane, as well as to reduce cell resistance and prevent damage to the electrode layer. In addition, the stable surface texture leads to stable electrolysis performance.

The titanium porous body in the form of the sheet may have the above three-dimensional surface texture on both one surface and other surface that is the reverse surface of the one surface. However, if at least one surface of the titanium porous body has the three-dimensional surface texture, effects such as improved adhesion to the other member can be obtained by arranging that surface in a PEM water electrolysis device or the like so that the surface faces another member such as an electrode layer.

(Production Method)

The above titanium porous body may be produced, for example, as described below.

First, a paste containing titanium powder, an organic binder, and an organic solvent is prepared in the past preparation step.

Here, titanium powder having a hydrogen content of 0.1% by mass or less is prepared and is added to the paste. If the hydrogen content of the titanium powder is more than 0.1% by mass, a large amount of hydrogen is released and the titanium powder significantly contracts during sintering in the sintering step. This can cause pinholes and the required smoothness of the surface of the titanium porous body cannot be ensured. The hydrogen content of the titanium powder may be 50 ppm by mass or more. Higher purity titanium powder is preferable, and pure titanium powder can be used. The titanium content of the titanium powder may be 99% by mass or more.

The titanium powders should be a pulverized powder. When the pulverized powder is used as the titanium powder, the number of contact points between the particles making up the pulverized powder increases, which is preferable in that the value of the bending strain at break increases. The pulverized powder is a powder produced by pulverizing a lump or the like. An example of such a pulverized powder is a hydride-dehydride titanium powder (so-called HDH powder) obtained by hydrogenating sponge titanium or the like, pulverizing it, and then dehydrogenating the resulting powder. The hydride-dehydride titanium powder tends to have a sufficiently low hydrogen content, which is particularly preferable. In addition, when using atomized titanium powder, there are concerns that the bending strain at break will be smaller in the case of the same porosity, and that sintering at an elevated temperature will cause greater waviness and make it impossible to maintain the sheet shape.

The titanium powder preferably has a 10% particle size D10 of 5 μm or more and 15 μm or less. The titanium powder also preferably has a 90% particle size D90 of 15 μm or more and 25 μm or less. If the 10% particle size D10 and the 90% particle size D90 of the titanium powder are in the above ranges, the titanium powder is fine, so that a titanium porous body that is in the form of the thin sheet shape and has a large bending strain at break can be produced.

The paste does not contain water or a foaming agent. This is to suppress the occurrence of pinholes on the surface of the titanium porous body, which is caused by the difference in drying behavior between the organic solvent and water when the paste contains water. Also, the absence of a foaming agent in the paste prevents local large voids caused by foaming of the foaming agent from being formed in the titanium porous body. As a result, the three-dimensional surface texture of the titanium porous body becomes smooth and cracks are difficult to occur during handling.

The organic binder and the organic solvent used in the paste can be appropriately selected from various substances. For example, the organic binder can be methyl cellulose-based, polyvinyl alcohol-based, ethyl cellulose-based, acrylic, polyvinyl butyral-based solvents, and the like. Hydrophobic organic binders are preferred. The organic solvent can be alcohol (ethanol, isopropanol, terpineol, butyl carbitol, etc.), toluene, cyclohexane, methyl ethyl ketone, and the like. However, they are not limited to the above-listed substances. As an example, the organic binder can be polyvinyl butyral and the organic solvent can be isopropyl alcohol. The paste may further contain a plasticizer (glycerin, ethylene glycol, or the like) and a surfactant (alkylbenzene sulfonate, or the like).

As the mass ratio of the organic binder and the organic solvent contained in the paste, a ratio (Ms/Mb) of the mass Ms of the organic solvent to the mass Mb of the organic binder is preferably 2.0 or more and 9.0 or less. The mass ratio (Ms/Mb) of the organic solvent to the organic binder of 2.0 or more and 9.0 or less results in an appropriate viscosity of the paste to obtain a smooth sheet having a predetermined thickness, and allows the porosity of the titanium porous body after sintering to be in a preferred range of 30% or more and 50% or less. Moreover, the mass ratio (Ms/Mb) is more preferably 2.5 or more and 6.0 or less, and even more preferably 3.0 or more and 5.0 or less. In the paste, for example, the content of the organic binder may be 5 g or more and 15 g or less, and the content of the organic solvent may be 25 g or more and 45 g or less, per 100 g of titanium powder.

The paste can be prepared by mixing the titanium powder, the organic binder, the organic solvent, and the like as described above, using, for example, a mixer with an agitator, a rotary mixer, a triple roll mill, and the like. At this time, the mixture may be pulverized using a vibration mill, a bead mill, or other pulverizing mixers.

In the paste application step, the above paste is relatively thinly applied onto a substrate. A release layer may be provided on the substrate in advance. In this case, the paste is applied onto the substrate via the release layer. When the release layer is provided on the substrate, it becomes easier to separate the molded body obtained by drying the paste after the drying step from the substrate.

Preferably as the substrate is a resin substrate because it is relatively inexpensive. Also, the resin substrate has an advantage that it is flexible and easily handled. Specific materials for the resin substrate include polyesters such as PET (polyethylene terephthalate) and PEN (polyethylene naphthalate), and polyvinyls such as polyethylene, polypropylene, polystyrene, and polyvinyl alcohol. Among them, PET is preferable in that it is inexpensive and it can easily separate the molded body from the substrate after the drying step as described below.

It is optional to provide the release layer on the substrate, but when the release layer is provided, a silicone coating or the like can be used as the release layer. For example, the release layer can be provided on the substrate by selecting a substrate on which such a material has been applied in advance, such as Cerapeel (registered trademark) from Toray. By providing the release layer on the substrate, the molded body in the form of thin sheet obtained after the drying step can be easily separated from the substrate.

In the drying step, the paste is dried on the substrate in, for example, an oven, a dryer or the like. This causes the organic solvent in the paste to evaporate, and provides a molded body in a form of a sheet on the substrate.

The drying temperature is 100° C. or more and 130° C. or less. By heating and drying the paste at a temperature in this range, it is possible to complete the drying in a relatively short period of time while suppressing boiling of the organic solvent and other components in the paste. In other words, if the drying temperature is more than 130° C., the organic solvent and other components in the paste may boil, which may lead to the occurrence of many localized rough spots on the surface of the titanium porous body, particularly on the surface facing the substrate. In other words, the smoothness of the surface of the titanium porous body is impaired. On the other hand, if the drying temperature is less than 100° C., it will be necessary to heat and dry the paste for a certain long period of time. In this case, pinholes are easily formed in the titanium porous body, and the smoothness of the surface of the titanium porous body is deteriorated.

The drying time is not particularly limited, and it may be determined as needed, for example, 5 minutes or more and 20 minutes or less. From the viewpoint of effectively removing the organic solvent from the paste, it is desirable to perform the drying while evacuating a gas from the furnace or the dryer. When evacuating the interior of the furnace or the dryer, the interior of the furnace or the dryer can in a reduced pressure atmosphere, or can have the same pressure as the outside pressure by feeding a gas such as the air atmosphere.

When the drying step is completed, before the preheating step, the molded body obtained by drying the paste can be separated from the substrate such as by peeling it from the substrate. By separating the molded body from the substrate at this stage, it is possible to suppress the deterioration of the sheet shape of the titanium porous body due to deformation of the substrate when the substrate is used in the subsequent preheating step or sintering step, and the contamination of the titanium porous body due to the material of the substrate. When the resin substrate is used, it becomes easy to separate the molded body from the substrate. In the case of a metal substrate, it may be difficult to separate the molded body from the substrate.

Next, in a preheating step, the molded body is heated in a furnace to volatilize and remove the organic substances such as the organic binder in the molded body. In the preheating step, for example, the molded body can be heated in an air atmosphere at a temperature of 300° C. or more and less than 450° C. for a period of time of 3 hours or more and 12 hours or less. The heating temperature in the preheating step is preferably more than 350° C. and less than 450° C.

The molded body that has been subjected to the preheating step is then subjected to a sintering step to sinter the titanium powder in the molded body. The conditions of the sintering step are not particularly limited as long as the titanium powder in the molded body is sintered. For example, in the sintering step, the molded body may be heated at a temperature of 700° C. or more and 850° C. or less for a period time of 1 hour to 4 hours. Since the titanium porous body according to this embodiment is relatively thin, the titanium powder can be appropriately sintered by heating at a relatively low temperature for a short period of time. The atmosphere during sintering may be, for example, a vacuum of $1.0\times10^{-2}$ Pa or less, or an inert atmosphere of Ar or He.

After the sintering step, the titanium porous body is obtained. As described above, the titanium porous body is in the form of the relatively thin sheet, is difficult to be broken during handling, and has a good smoothness for at least one surface.

EXAMPLES

Next, the titanium porous body according to the present invention was experimentally produced, and its performance was evaluated as described below. However, descriptions herein are merely for illustration, and are not intended to be limited thereto.

As the titanium powder, HDH powder (pulverized powder) was prepared in Examples 1 to 4 and Comparative Examples 1 to 4 and 6, and HDH powder (pulverized powder) that had been lightly dehydrogenated was prepared in Comparative Example 5. Atomized powder was used in Comparative Example 7. All titanium powders had a titanium content of 99% by mass or more. The types of titanium powders, hydrogen contents, 10% particle sizes D10, and 90% particle sizes D90 are shown in Table 1.

Each of the above titanium powders was mixed with polyvinyl butyral as an organic binder and isopropyl alcohol as an organic solvent to prepare a paste. The paste contained the organic binder and the organic solvent in the mass ratio (Ms/Mb) shown in Table 1. In Comparative Example 6, a paste containing water was used. More specifically, the paste of Comparative Example 6 contained 3% by mass of water, and the organic binder and the organic solvent were reduced by 3% by mass compared to the other examples. The mass ratio (Ms/Mb) in Comparative Example 6 is as shown in Table 1.

The paste was then applied onto a substrate (Cerapeel (registered trademark) manufactured by Toray), and the paste on the substrate was heated and dried at the temperature shown in Table 1 to obtain a molded body in a form of a sheet. The drying time was 10 minutes. After drying, the molded body was separated from the substrate. Although a detailed description will be omitted herein, when the paste was applied to a metal substrate instead of the PET resin substrate and dried, it was sometimes difficult to separate the molded body from the metal substrate after drying.

Next, as preheating, the molded body was heated in an air atmosphere at 360° C. for 360 minutes to volatilize organic substances such as the organic binder. The molded body was then heated at 800° C. for 1 hour to sinter the titanium powder in the molded body, thereby obtaining a titanium porous body as a sintered body. The atmosphere during sintering was a vacuum of $1.0\times10^{-2}$ Pa or less. In Comparative Example 7, the sintering temperature was adjusted so that the porosity of the titanium porous body was about 40%. Since the porosity affects the air permeability and liquid permeability of the titanium porous body, the sintering temperature was adjusted so that the porosity of Comparative Example 7 was substantially the same as that of the other examples.

The thickness, carbon content (carbon amount), porosity, and breaking bending at break of each titanium porous body were confirmed by the methods as described above, and were as shown in Table 1. The titanium content of each of the titanium porous bodies was 98% by mass or more.

The titanium porous body was also held against light using a Tritek A2-450 tracing stand to confirm the presence or absence of pinholes. The results are shown in Table 1. A pinhole is a hole through which light can be seen to pass with the naked eyes.

TABLE 1

| | Titanium Powder | | | | Paste | | Drying Step | Titanium Porous Body | | | | |
|---|---|---|---|---|---|---|---|---|---|---|---|---|
| | Type | Hydrogen Amount (wt %) | D10 (μm) | D90 (μm) | Solver/Binder Mass Ratio (Ms/Mb) | Water | Drying Temp. (° C.) | Thickness (μm) | Carbon Amount (mass %) | Porosity (%) | Bending Strain at Break (−) | Pinhole |
| Ex. 1 | Pulverized | 0.05 | 8 | 20 | 5.5 | No | 120° C. | 0.04 | 0.03 | 45 | No Breakage at 0.006 or more | No |
| Ex. 2 | Pulverized | 0.05 | 8 | 20 | 4.5 | No | 120° C. | 0.1 | 0.03 | 42 | No Breakage at 0.009 or more | No |
| Ex. 3 | Pulverized | 0.05 | 8 | 20 | 3.5 | No | 120° C. | 0.18 | 0.03 | 40 | 0.007 | No |
| Ex. 4 | Pulverized | 0.05 | 8 | 20 | 2.5 | No | 120° C. | 0.23 | 0.03 | 38 | 0.008 | No |
| Comp. 1 | | 0.05 | 8 | 20 | 5.5 | No | 150° C. | 0.04 | 0.03 | 45 | No Breakage at 0.006 or more | No |
| Comp. 2 | Pulverized | 0.05 | 8 | 20 | 3.5 | No | 150° C. | 0.18 | 0.03 | 40 | 0.006 | No |
| Comp. 3 | Pulverized | 0.05 | 8 | 20 | 5.5 | No | 80° C. | 0.04 | 0.03 | — | — | Yes |
| Comp. 4 | Pulverized | 0.05 | 8 | 20 | 3.5 | No | 80° C. | 0.18 | 0.03 | — | — | Yes |
| Comp. 5 | Pulverized | 0.2 | 8 | 20 | 3.5 | No | 120° C. | 0.18 | 0.03 | — | — | Yes |
| Comp. 6 | Pulverized | 0.05 | 8 | 20 | 3.5 | Yes | 120° C. | 0.18 | 0.03 | — | — | Yes |
| Comp. 7 | Atomized | 0.01 | 6 | 18 | 3.5 | No | 120° C. | 0.18 | 0.03 | 42 | 0.003 | No |

Furthermore, the three-dimensional surface texture of the surface of each titanium porous body facing the substrate (substrate-side surface) were measured by the above methods for the arithmetic mean height Sa, the maximum height Sz, the aspect ratio Str of the surface texture, and the arithmetic mean curvature Spc of the peak at five locations on the substrate-side surfaces A to E. The measurement results for each of the substrate-side surfaces A to E and their average values are shown in Table 2.

In addition, the pinholes were formed in the titanium porous bodies according to Comparative Examples 3 to 6, so they cannot be said to be good titanium porous bodies, and for this reason, the porosity, the bending strain at break, and the three-dimensional surface texture were not confirmed. Possible reasons for the formation of pinholes are that the drying temperature was too low in Comparative Examples 3 and 4, which prolonged the drying time, and that the hydrogen content of the titanium powder in Comparative Example 5 was higher, and thus much hydrogen was released during sintering, causing significant contraction, and that the paste in Comparative Example 6 contained water, which showed different behavior from that of the organic solvent during drying.

TABLE 2

| | Substrate-Side Surface A | | | | Substrate-Side Surface B | | | | Substrate-Side Surface C | | | | Substrate-Side Surface D |
|---|---|---|---|---|---|---|---|---|---|---|---|---|---|
| | Sa (μm) | Sz (μml) | Str (–) | Spc (1/μm) | Sa (μm) | Sz (μm) | Str (–) | Spc (1/μml) | Sa (μml) | Sz (μm) | Str (—) | Spc (1/μm) | Sa (μm) |
| Ex. 1 | 1.6 | 23 | 0.99 | 2.9 | 1.7 | 23 | 0.96 | 4.2 | 1.6 | 23 | 0.97 | 3.4 | 1.7 |
| Ex. 2 | 1.6 | 25 | 0.95 | 3.4 | 2.1 | 25 | 0.99 | 4.2 | 1.8 | 25 | 0.97 | 3.8 | 1.6 |
| Ex. 3 | 1.7 | 25 | 0.97 | 2.4 | 1.9 | 25 | 0.96 | 4.5 | 1.7 | 26 | 0.96 | 3.1 | 1.9 |
| Ex. 4 | 1.8 | 24 | 0.98 | 4.1 | 1.9 | 24 | 0.95 | 3.9 | 2.0 | 27 | 0.94 | 3.8 | 1.8 |
| Comp. 1 | 2.5 | 31 | 0.94 | 4.3 | 3.1 | 33 | 0.88 | 4.9 | 2.2 | 28 | 0.95 | 5.1 | 4.2 |
| Comp. 2 | 4.8 | 52 | 0.87 | 5.1 | 4.1 | 40 | 0.89 | 4.9 | 3.8 | 46 | 0.95 | 4.5 | 3.2 |
| Comp. 3 | — | — | — | — | — | — | — | — | — | — | — | — | — |
| Comp. 4 | — | — | — | — | — | — | — | — | — | — | — | — | — |
| Comp. 5 | — | — | — | — | — | — | — | — | — | — | — | — | — |
| Comp. 6 | — | — | — | — | — | — | — | — | — | — | — | — | — |
| Comp. 7 | 1.5 | 21 | 0.97 | 2.6 | 1.7 | 23 | 0.98 | 2.6 | 1.7 | 24 | 0.98 | 2.9 | 1.6 |

| | Substrate-Side Surface D | | | Substrate-Side Surface E | | | | Average Value of Substrate Side Surfaces | | | |
|---|---|---|---|---|---|---|---|---|---|---|---|
| | Sz (μm) | Str (–) | Spc (1/μm) | Sa (μml | Sz (μm) | Str (–) | Spc (1/μml) | Sa (μm) | Sz (μm) | Str (—) | Spc (1/μm) |
| Ex. 1 | 24 | 0.96 | 3.2 | 1.9 | 23 | 0.97 | 2.9 | 1.7 | 23 | 0.97 | 3.3 |
| Ex. 2 | 26 | 0.98 | 3.4 | 1.9 | 25 | 0.98 | 3.3 | 1.8 | 25 | 0.97 | 3.6 |
| Ex. 3 | 24 | 0.96 | 2.9 | 2.2 | 24 | 0.95 | 3.5 | 1.9 | 25 | 0.96 | 3.3 |
| Ex. 4 | 25 | 0.98 | 3.5 | 1.8 | 21 | 0.97 | 3.9 | 1.9 | 24 | 0.96 | 3.8 |
| Comp. 1 | 42 | 0.89 | 5.1 | 3.7 | 39 | 0.92 | 5.2 | 3.1 | 35 | 0.92 | 4.9 |
| Comp. 2 | 33 | 0.95 | 4.7 | 4.1 | 35 | 0.89 | 5.1 | 4.0 | 41 | 0.91 | 4.9 |
| Comp. 3 | — | — | — | — | — | — | — | — | — | — | — |
| Comp. 4 | — | — | — | — | — | — | — | — | — | — | — |
| Comp. 5 | — | — | — | — | — | — | — | — | — | — | — |
| Comp. 6 | — | — | — | — | — | — | — | — | — | — | — |
| Comp. 7 | 22 | 0.97 | 2.5 | 1.9 | 25 | 0.97 | 2.4 | 1.7 | 23 | 0.97 | 2.6 |

In Examples 1 to 4, a paste free of water and a foaming agent was prepared using titanium powder having a lower hydrogen content, and dried at the specified temperature, so that all of the arithmetic mean height Sa, the maximum height Sz, the aspect ratio Str of the surface texture, and the arithmetic mean curvature Spc of the peak of each titanium porous body were desirable values. Also, the bending strain at break was good for Examples 1 to 4.

In Comparative Examples 1 and 2, the drying temperature was higher, so that at least one of the surface roughness of each titanium porous body, the arithmetic mean height Sa, the maximum height Sz, the aspect ratio Str of the surface texture, and the arithmetic mean curvature Spc of the peak was undesirable values. Particularly, in Comparative Examples 1 and 2, there were five measurement points for the four surface roughnesses, some of which met the criteria and some of which did not met the criteria, and it was difficult to predict previously, which surface roughness would be undesirable. On the other hand, if the average value of the five points is confirmed, it is possible to determine whether the criteria are met, which is effective. In addition, in all of Examples 1 to 4, the average values as well as all measurement results at the five points met the criteria, so that good smoothness would be achieved over a wide area.

In Comparative Example 7, the titanium porous body was produced using substantially the same paste composition and drying temperature as in Example 3, with the exception that the titanium powder was changed from the pulverized powder to the atomized powder. In Comparative Example 7, the sintering temperature was adjusted so that the porosity of the titanium porous body would be about 40%. As a result, the titanium porous body according to Comparative Example 7 had the desirable surface roughness values, but the bending strain at brake was lower so that both the desired porosity and bending strain at break could not be achieved.

In the foregoing, it was found that according to the present invention, it is possible to obtain a titanium porous body that is in the form of a relatively thin sheet, is difficult to be broken during handling, and has at least one smooth surface.

The invention claimed is:

1. A titanium porous body in a form of a sheet, the titanium porous body having:

a thickness of 0.3 mm or less, and a bending strain at break of 0.005 or more, wherein, for a three-dimensional surface texture of at least one surface of the titanium porous body, an arithmetic mean height Sa is 2.5 μm or less, a maximum height Sz is 30 μm or less, an aspect ratio Str of the surface texture is 0.93 or more, and an arithmetic mean curvature Spc of a peak is 4.8 (1/μm) or less.

2. The titanium porous body according to claim 1, wherein the titanium porous body has a porosity of 30% or more and 50% or less.

3. The titanium porous body according to claim 1, wherein the titanium porous body has a titanium content of 97% by mass or more.

4. The titanium porous body according to claim 1, wherein the titanium porous body has a carbon content of 0.01% by mass or more and 0.06% by mass or less.

5. A method for producing the titanium porous body in a form of a sheet according to claim 1, the method comprising:

a drying step of drying a paste applied onto a substrate by heating the paste on the substrate at a temperature of 100° C. or more and 130° C. or less to obtain a molded body in a form of a sheet, the paste containing titanium powder, an organic binder, and an organic solvent, the titanium powder being a pulverized powder having a hydrogen content of 0.1% by mass or less, the paste being free of water or a foaming agent;

a preheating step of heating the molded body to volatilize organic substances in the molded body; and a sintering step of heating the molded body after the preheating step to sinter the titanium powder in the molded body.

6. The method for producing a titanium porous body according to claim 5, wherein the preheating step is carried out after separating the molded body obtained in the drying step from the substrate.

7. The method for producing a titanium porous body according to claim 5, wherein the titanium powder in the paste used in the drying step has a 10% particle size D10 of 5 μm or more and 15 μm or less, and a 90% particle size D90 of 15 μm or more and 25 μm or less.

8. The method for producing a titanium porous body according to claim 5, wherein the drying step uses, as the paste, a paste having a ratio (Ms/Mb) of a mass Ms of the organic solvent to a mass Mb of the organic binder of 2.0 or more and 9.0 or less.

9. The method for producing a titanium porous body according to claim 5, wherein the titanium powder is a hydride-dehydride titanium powder.

10. The method for producing a titanium porous body according to claim 5, wherein a ratio (Ms/Mb) of a mass Ms of the organic solvent to a mass Mb of the organic binder in the paste is 2.5 or more and 6.0 or less.

11. The method for producing a titanium porous body according to claim 5, wherein in the preheating step, the molded body is heated in an air atmosphere at a temperature of 300° C. or more and less than 450° C. for a period of time of 3 hours or more and 12 hours or less.

12. The method for producing a titanium porous body according to claim 5, wherein in the sintering step, the molded body is heated at a temperature of 700° C. or more and 850° C. or less for a period of time of 1 hour or more and 4 hours or less.

13. The titanium porous body according to claim 1, obtained by a method for producing a titanium porous body in a form of a sheet, the method comprising:

a drying step of drying a paste applied onto a substrate by heating the paste on the substrate at a temperature of 100° C. or more and 130° C. or less to obtain a molded body in a form of a sheet, the paste containing titanium powder, an organic binder, and an organic solvent, the titanium powder being a pulverized powder having a hydrogen content of 0.1% by mass or less, the paste being free of water or a foaming agent;

a preheating step of heating the molded body to volatilize organic substances in the molded body; and a sintering step of heating the molded body after the preheating step to sinter the titanium powder in the molded body.

14. The titanium porous body according to claim 13, wherein the preheating step is carried out after separating the molded body obtained in the drying step from the substrate.

15. The titanium porous body according to claim 13, wherein the titanium powder in the paste used in the drying step has a 10% particle size D10 of 5 μm or more and 15 μm or less, and a 90% particle size D90 of 15 μm or more and 25 μm or less.

16. The titanium porous body according to claim 13, wherein the drying step uses, as the paste, a paste having a ratio (Ms/Mb) of a mass Ms of the organic solvent to a mass Mb of the organic binder of 2.0 or more and 9.0 or less.

17. The titanium porous body according to claim 13, wherein the titanium powder is a hydride-dehydride titanium powder.

18. The titanium porous body according to claim 13, wherein a ratio (Ms/Mb) of a mass Ms of the organic solvent to a mass Mb of the organic binder in the paste is 2.5 or more and 6.0 or less.

19. The titanium porous body according to claim 13, wherein in the preheating step, the molded body is heated in an air atmosphere at a temperature of 300° C. or more and less than 450° C. for a period of time of 3 hours or more and 12 hours or less.

20. The titanium porous body according to claim 13, wherein in the sintering step, the molded body is heated at a temperature of 700° C. or more and 850° C. or less for a period of time of 1 hour or more and 4 hours or less.

* * * * *